US005829790A

United States Patent [19]

Phillips

[11] Patent Number: 5,829,790

[45] Date of Patent: Nov. 3, 1998

[54] GREETING CARD KIT HAVING ASSOCIATED ADHESIVE LABELS OR STICKERS FOR CUSTOMIZED GREETING CARDS

[75] Inventor: Richard L. Phillips, West Chester, Ohio

[73] Assignee: NCR Corporation, Dayton, Ohio

[21] Appl. No.: 688,138

[22] Filed: Jul. 29, 1996

[51] Int. Cl.[6] ..... B42D 15/02

[52] U.S. Cl. ..... 283/117; 281/2; 281/5; 281/51; 283/81; 283/101; 283/61; 283/62

[58] Field of Search ..... 283/117, 81, 61, 283/101, 62; 281/51, 2, 5; 40/638, 594, 124.01, 124.19; 434/156, 428, 430

[56] References Cited

U.S. PATENT DOCUMENTS

| | | | |
|---|---|---|---|
| 416,171 | 12/1889 | Mahoney . | |
| 2,694,264 | 11/1954 | Seaton | 434/156 |
| 2,824,394 | 2/1958 | Lohnes | 40/124.13 |
| 2,862,309 | 12/1958 | Von Der Hellen | 434/156 |
| 3,383,121 | 5/1968 | Singer . | |
| 3,750,309 | 8/1973 | Tovar . | |
| 4,235,459 | 11/1980 | Callahan . | |
| 4,439,941 | 4/1984 | Halperin . | |
| 4,510,006 | 4/1985 | Lawson . | |
| 4,568,108 | 2/1986 | Simpson . | |
| 4,627,994 | 12/1986 | Welsch . | |
| 4,652,239 | 3/1987 | Brimberg . | |
| 4,712,673 | 12/1987 | Moore . | |
| 4,778,153 | 10/1988 | Bachman et al. . | |
| 4,809,905 | 3/1989 | Goodman . | |
| 4,811,951 | 3/1989 | Dorsey-Zinn et al. . | |
| 4,944,968 | 7/1990 | Wagner . | |
| 4,983,438 | 1/1991 | Jameson . | |
| 4,997,126 | 3/1991 | Amoss | 229/92.8 |
| 5,006,191 | 4/1991 | Schmidt . | |
| 5,036,472 | 7/1991 | Buckley et al. . | |
| 5,096,752 | 3/1992 | Wagner . | |
| 5,106,305 | 4/1992 | Grant . | |
| 5,120,090 | 6/1992 | Reinl | 283/117 |
| 5,129,682 | 7/1992 | Ashby . | |
| 5,135,789 | 8/1992 | Schmidt . | |
| 5,244,394 | 9/1993 | Serabian-Musto . | |
| 5,248,536 | 9/1993 | Du Katz . | |
| 5,262,215 | 11/1993 | Shields . | |
| 5,269,691 | 12/1993 | Waldman . | |
| 5,292,154 | 3/1994 | Williams . | |
| 5,318,327 | 6/1994 | Daneshvar | 283/117 |
| 5,377,904 | 1/1995 | Michlin et al. . | |
| 5,397,052 | 3/1995 | Walz . | |
| 5,507,901 | 4/1996 | Limina et al. . | |
| 5,512,612 | 4/1996 | Brown et al. . | |
| 5,531,038 | 7/1996 | Keith | 40/124.12 |
| 5,577,915 | 11/1996 | Feldman | 434/430 X |
| 5,660,548 | 8/1997 | Ellenbogen | 434/156 X |

FOREIGN PATENT DOCUMENTS

| | | | |
|---|---|---|---|
| 1564117 | 3/1969 | France | 434/428 |
| 441900 | 11/1925 | Germany . | |
| 9315699 | 2/1994 | Germany . | |
| 1039988 | 8/1966 | United Kingdom | 434/428 |
| 1315931 | 5/1973 | United Kingdom | 434/428 |
| 2090146 | 7/1982 | United Kingdom . | |

*Primary Examiner*—Frances Han
*Attorney, Agent, or Firm*—Charlene Stukenborg

[57] ABSTRACT

A single unit greeting card kit is provided having associated stickers for customizing and personalizing a greeting card portion. An integrated envelope may also be provided.

12 Claims, 7 Drawing Sheets

FIG. 2
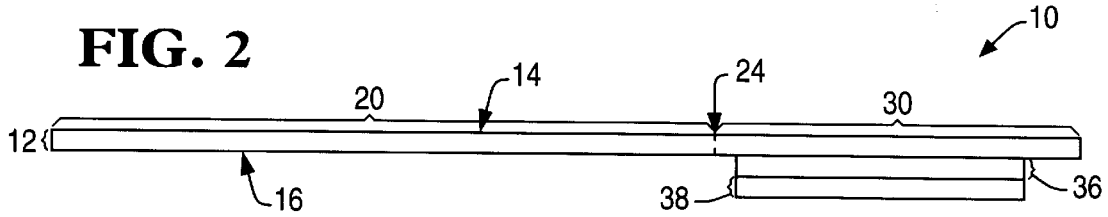
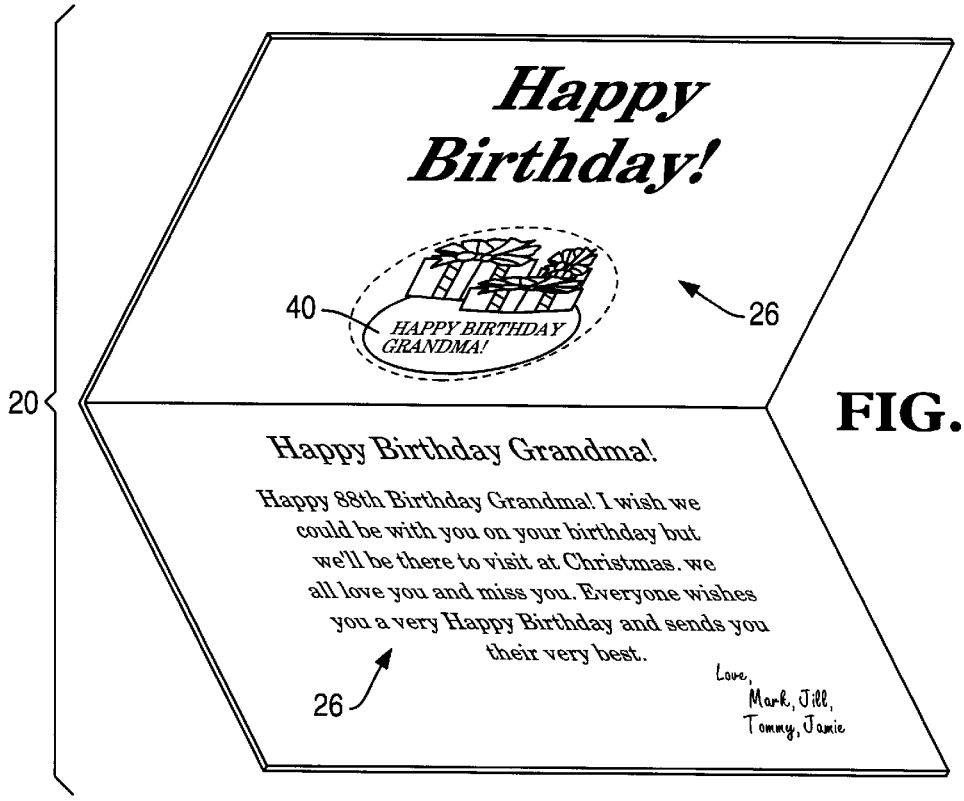
FIG. 4
FIG. 6
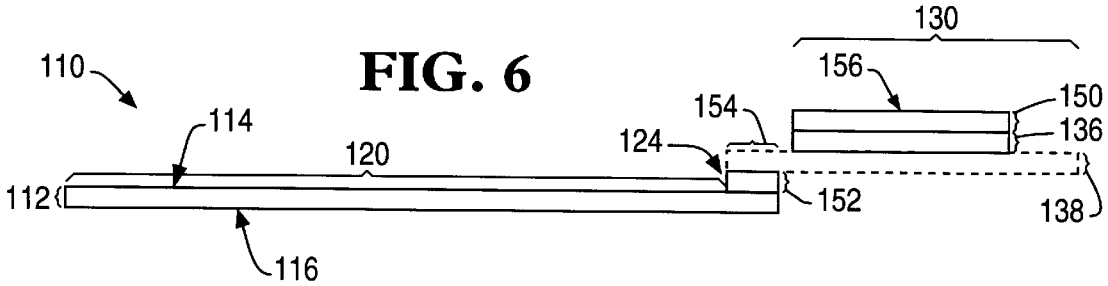
FIG. 9
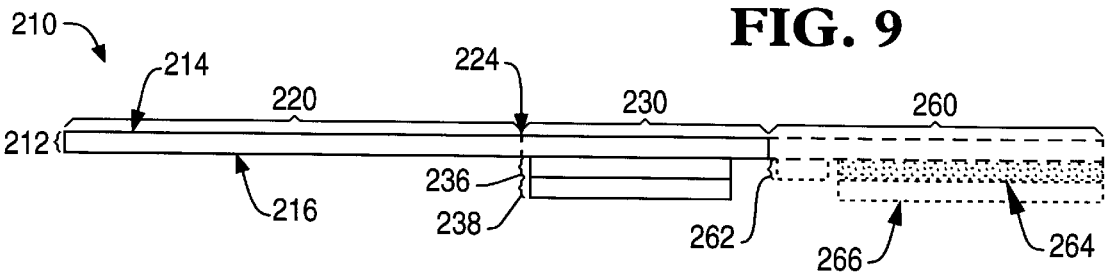

GREETING CARD KIT HAVING ASSOCIATED ADHESIVE LABELS OR STICKERS FOR CUSTOMIZED GREETING CARDS

BACKGROUND OF THE INVENTION

The present invention relates to greeting cards, particularly greeting cards having associated adhesive stickers for making customized greeting cards.

Greeting card products are preferably designed for all occasions and all types of demographic groups. Currently, manufacturers provide preprinted greeting cards for a variety of occasions. However, these cards are mass-produced, and as such are not personalized. Greeting card machines are available in stores to print customized cards. However, these are not convenient for persons desiring to have a stock of cards at home in advance of special occasions. Also the cost of maintaining these machines may add to the cost of the card. Customized greeting cards can also be produced on personal computers with attached printers. These cards are often limited in detail by the ability of the printer and the paper used. Customized cards produced on PC's may require multiple constructions and laminated papers to provide a professional finish.

There is a need for a greeting card kit with associated stickers which has a unique construction and design for convenience in packaging, handling and storage which is more economical than current customized cards.

SUMMARY OF THE INVENTION

In accordance with the teachings of the present invention, a single unit greeting card kit is provided having associated stickers for customizing and personalizing a greeting card portion.

It is an object of the present invention to provide a customized, create-your-own greeting card kit that provides new customer benefits and user-friendliness.

It is another object of the present invention to provide a customized greeting card kit which has an integrated or single unit construction. This unique construction and design allows for more convenience in packaging, handling, and storage. This unique one-piece integrated construction makes it compatible with today's home computer PC's having non-impact printer output such as color ink jet and laser.

It is yet another object of the present invention to provide a greeting card kit for either hand generation or computer generation of a personalized greeting card. This greeting card kit can also have varied degrees of pre-printed copy and either hand printed and/or computer generated copy. The computer with associated software can also be utilized to provide an inventory of messages that are associated with and compatible with the pre-printing copy and the labels.

BRIEF DESCRIPTION OF THE DRAWINGS

Additional benefits and advantages of the present invention will become apparent to those skilled in the art to which this invention relates from the subsequent description of the preferred embodiments and the appended claims, taken in conjunction with the accompanying drawings, in which:

FIGS. 1, 2, and 3 show a greeting card kit according to a first embodiment of the present invention;

FIG. 4 shows a personalized, customized greeting card created according to the present invention;

FIGS. 5, 6, and 7 show a greeting card kit according to a second embodiment of the present invention; and FIGS. 8, 9 and 10 show a greeting card kit according to a third embodiment of the present invention.

DETAILED DESCRIPTION

Figure 1:
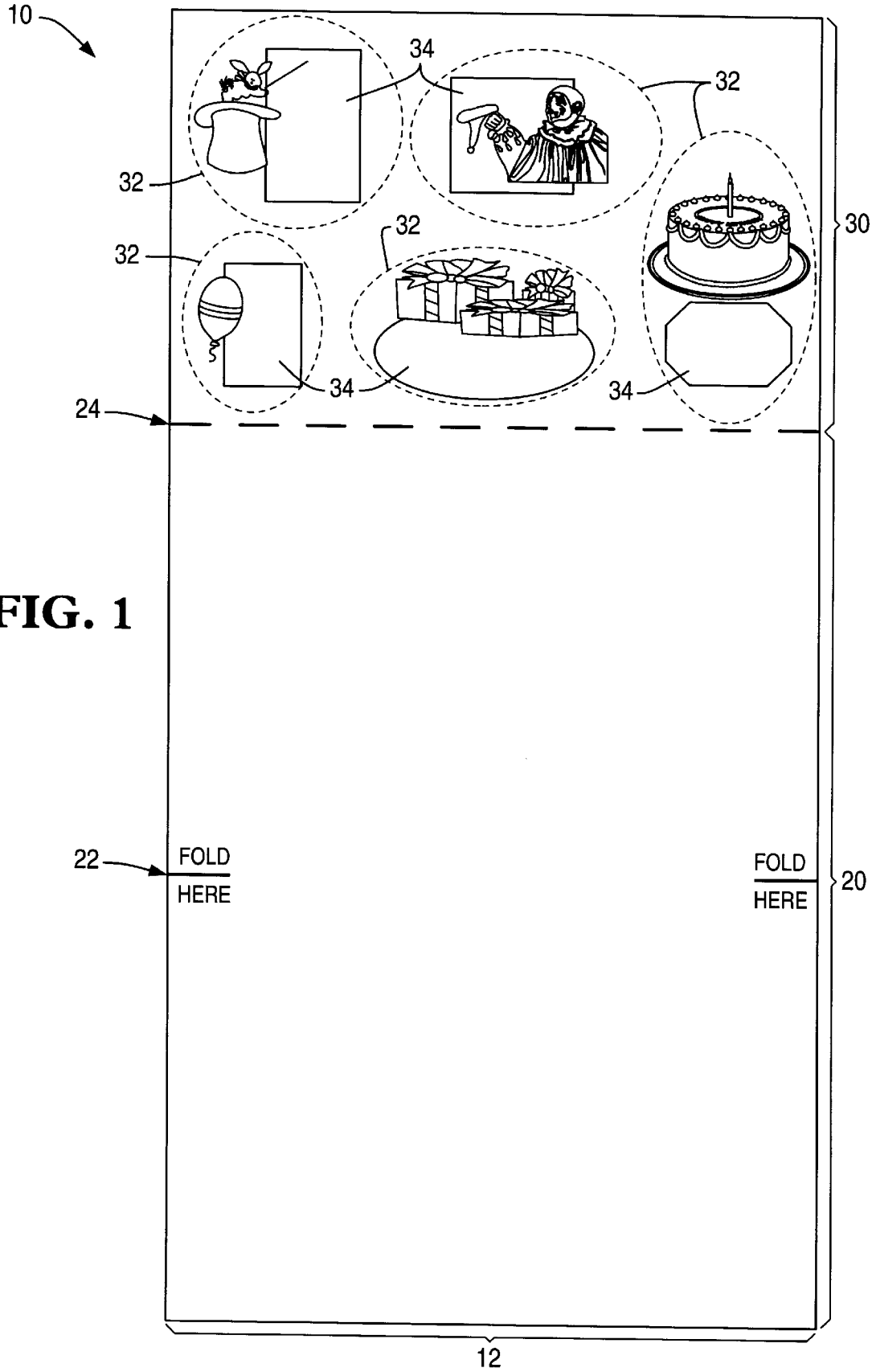
Figure 3:
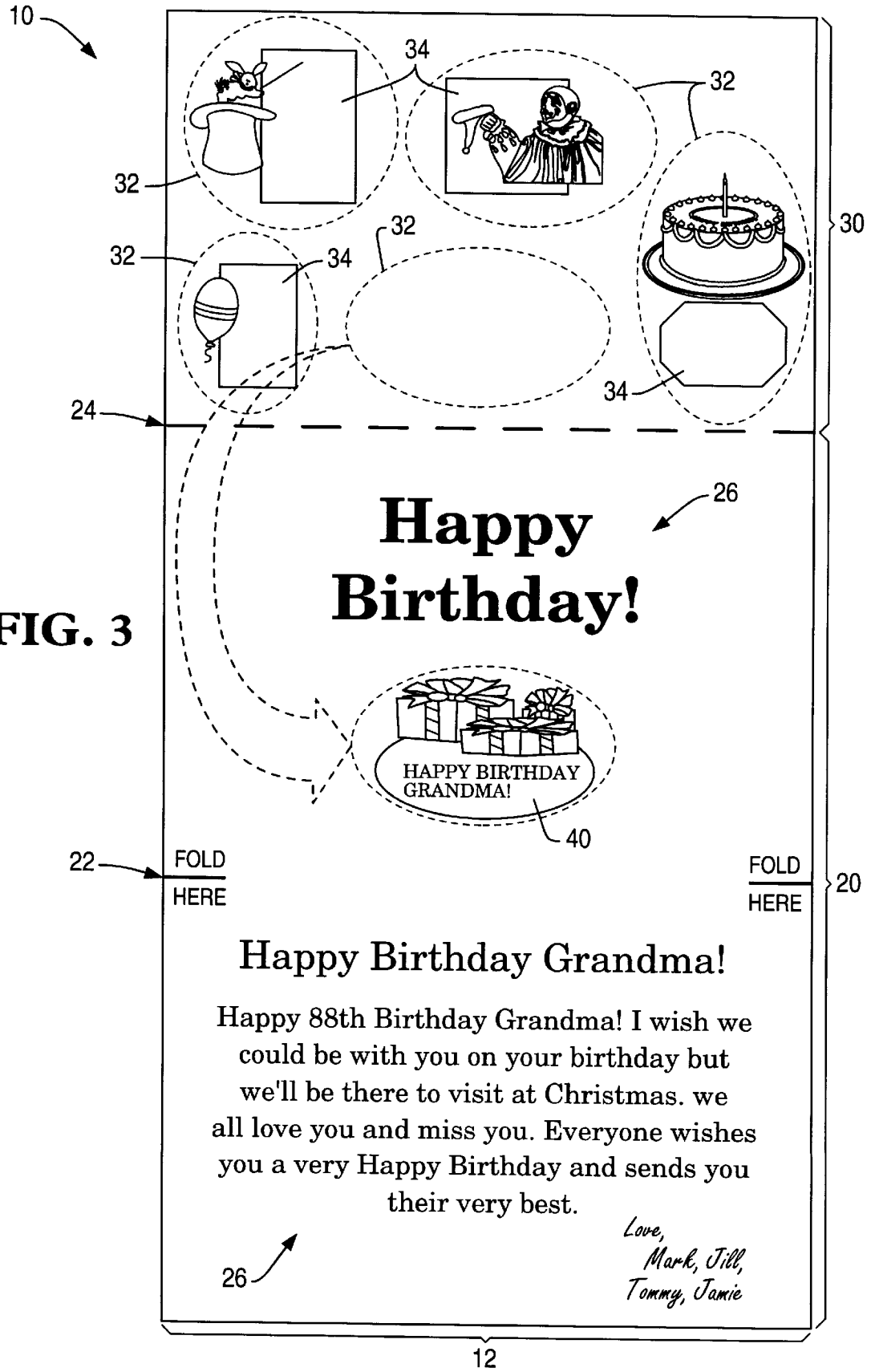

Referring now to the drawings, in which like-referenced characters indicate corresponding elements throughout the several views, attention is first drawn to FIGS. 1, 2 and 3.

FIG. 1 illustrates a top view of a first embodiment of a greeting card kit 10 having a greeting card portion 20 and an integrated sticker portion 30. Greeting card portion 20 maybe blank but may include a fold indication 22 or other standard printing. Alternatively, greeting card portion 20 and/or integrated sticker portion 30 may be pre-printed with high quality lithography printing or other printing processes. A perforation line 24 divides greeting card portion 20 and integrated sticker portion 30. Perforation line 24 is preferably a micro perforation. Integrated sticker portion 30 includes die cuts 32 and stickers 34. Stickers 34 are preferably preprinted to be associated with a specific theme or scene. A sticker 34 may additionally include a mailing address or return address label.

FIG. 2 illustrates a side view of the greeting card kit 10 of FIG. 1. Greeting card kit 10 includes a single sheet of paper 12 having a front surface 14 and a rear surface 16. Paper sheet 12 can be 20 pound to 80 pound paper stock, including bond, laser, ink jet, tag, ledger, vellum, offset, etc. Preferably paper sheet 12 is bond paper. Paper sheet 12 may be of a variety of colors to enhance the personalized message. Greeting card kit 10 also includes an adhesive layer 36 and release liner 38. Adhesive layer 36 is preferably a pressure sensitive adhesive and is applied to the rear surface 16 of the sticker portion 30 of paper sheet 12. Release liner 38 is formed of liner paper coated with silicone, as is commonly known, and is applied to the adhesive layer 36. Release liner 38 could alternatively be any type of release coated paper such as silicone-coated kraft paper. Adhesive layer 36 forms a permanent bond with the uncoated surface of paper sheet 12 and temporarily holds the silicone-coated release liner 38 in place. To form stickers 34, sticker portion 30 of paper sheet 12 is die-cut through front surface 14 into one or more shapes, preferably corresponding to preprinted shapes to create one or more stickers. Additionally, a mailing address or return label portion may also be die-cut if desired. In the finished construction, the paper sheet 12 die-cut stickers can be easily removed because the adhesive 36 has attached permanently to their back surface and because the silicone-coated liner 38 allows the adhesive to release easily.

FIG. 3 shows the greeting card kit 10 of FIG. 1 which has been customized to provide a birthday card for "Grandma". Personalized greetings and information 26 may be added by hand, type writer or computer generation. As the paper sheet 12 is preferably bond paper, standard ink markers, pens, crayons, etc. may be used to personalize the card. If computer generation is selected, the user has preferably been provided with specialized software to instruct the computer and printer what and where to print on the card portion and/or the sticker portion. Selected stickers 34 are removed from sticker portion 30 and include paper and adhesive as the adhesive releases from the release liner 38. After being removed from release liner 38, selected sticker 40 is applied to the front surface 14 or rear surface 16 of paper sheet 12 in the greeting card portion 20. Additionally if a mailing address or return address portion is desired, the label may be removed from sticker portion and applied to a separately supplied envelope. These address labels can be hand printed or software generated using a computer and printer. This greeting card kit can be produced to be compatible with different variations of pre-printed and either hand printed or computer generated information by the actual end-user.

FIG. 4 shows the customized greeting card which has been bursted (removed) from the integrated greeting card kit 10. Sticker portion 30 has been removed from greeting card portion 20 along perforation line 24 (FIG. 3). Greeting card portion 20 may be folded along fold indication 22 and placed in a separate envelope for mailing or protection.

Advantageously, this design provides a greeting card kit having a reduced thickness and a single plane design which can be smoothly run through computer printers to enable printing of personalized greetings to be added to the greeting card and sticker portion to create a customized greeting card.

Another advantage of this design is that the greeting card and/or stickers can be preprinted lithographically with any desired theme. This lithographic printing may provide higher print quality and better resolution to provide a professionally finished customized greeting card.

Still another advantage of this design is that the one piece construction having the sticker portion integrated into the card stock also forming the greeting card portion provides easy handling and simple packaging compared to multi-piece kits.

Yet another advantage of this design is that micro perforations used for separating the greeting card and sticker portions after the customized greeting card has been created avoid the torn edges associated with standard perforations and lower grade products.

Figure 5:
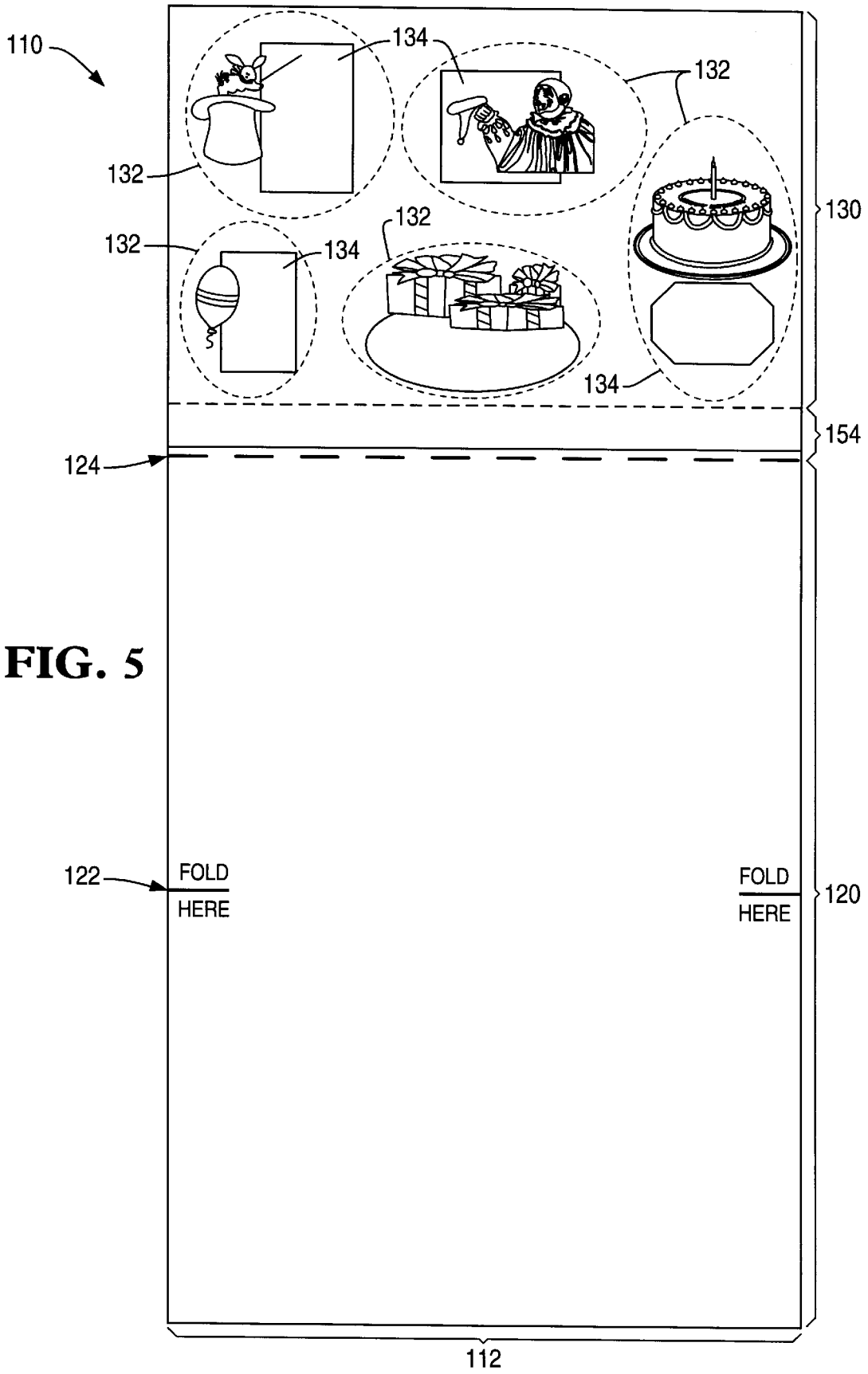
Figure 7:
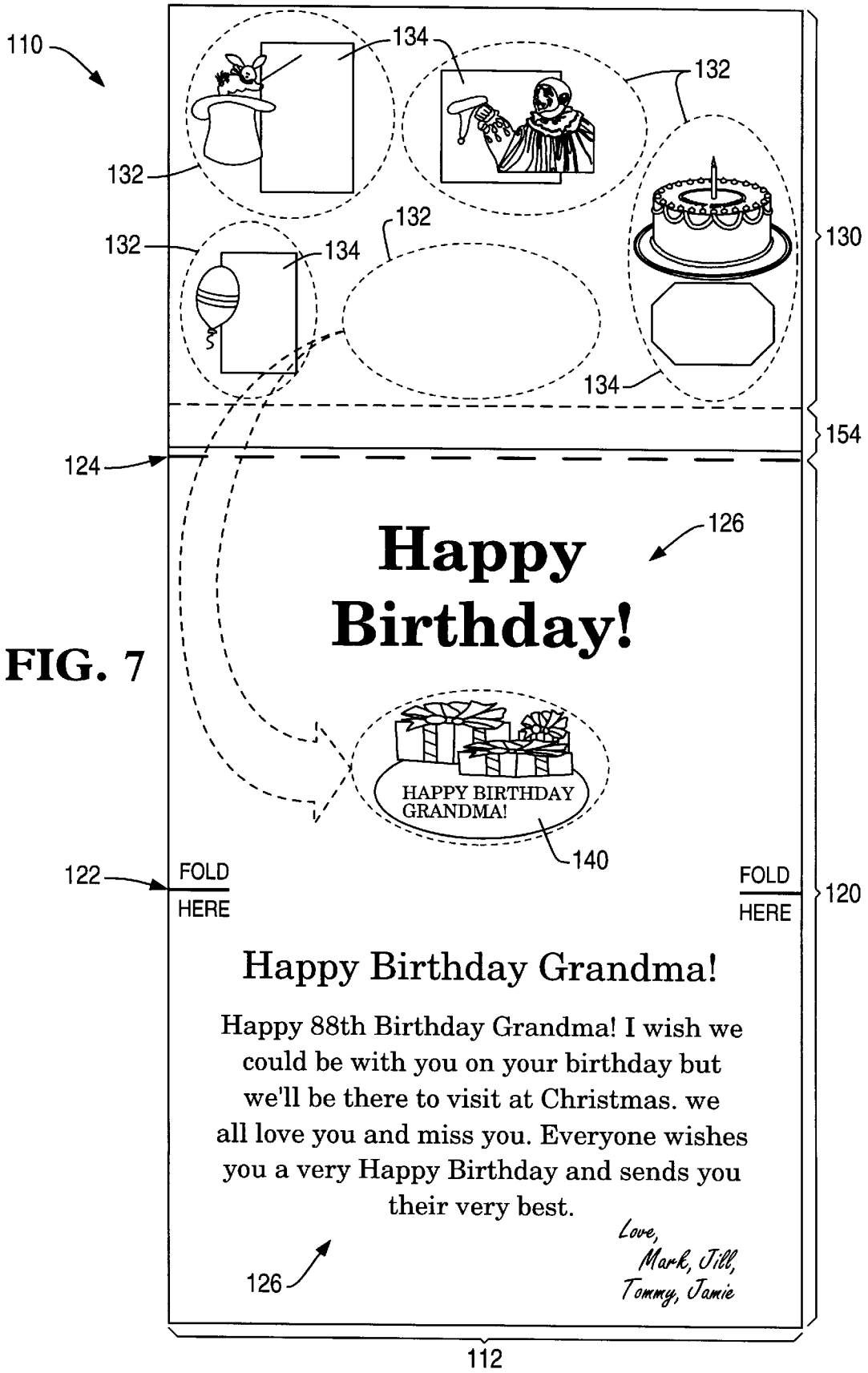

FIGS. 5, 6 and 7 show a greeting card kit according to a second embodiment of the present invention. FIG. 5 illustrates a top view of a greeting card kit 110 having a greeting card portion 120, lap joined or overlap portion 154 and a sticker portion 130. Greeting card portion 120 may be blank but may include a fold indication 122 or other standard printing. Alternatively, greeting card portion and/or sticker portion 130 may be pre-printed. A perforation line 124 divides greeting card portion 120 and lap joined portion 154. Perforation line 124 is preferably a micro perforation. Lap joined portion 154 includes a portion of paper sheet 112.

Integrated sticker portion 130 includes die cuts 132 and stickers 134. Stickers 134 are preferably preprinted to be associated with a specific theme or scene. A sticker 134 may additionally include a mailing address or return address label.

FIG. 6 illustrates a side view of the greeting card kit 110 of FIG. 5. Greeting card kit 110 includes a greeting card portion 120 formed of a single sheet of paper 112 having a front surface 114 and a rear surface 116. Paper sheet 112 can be 20 pound to 80 pound paper stock, including bond, laser, ink jet, tag, ledger, vellum, offset, etc. Preferably paper 112 is bond paper. Paper sheet 112 extends into lap joined portion 154. Sticker portion 130 has a release liner 138 which also extends into lap joined portion 154 and is attached to paper sheet 112 by permanent glue 152. Sticker portion 130 also includes a sticker sheet layer 150 and adhesive layer 136. Sticker sheet layer 150 may be of the same material as sheet 112 or may be of any other suitable material to provide stickers to be attached to greeting card portion 120. Adhesive layer 136 and release liner 138 may be as described above in the discussion of the first embodiment. To form stickers 134, sticker portion 130 is die-cut through front surface 156 into one or more shapes, preferably corresponding to preprinted shapes to create one or more stickers. Additionally, a mailing address or return label portion may also be die-cut if desired.

FIG. 7 shows the greeting card kit 110 after customization by printing indicia 126 in the greeting card portion 120 and sticker portion 130 and having at least one sticker 140 applied in the greeting card portion 120. After customization, lap joined portion 154 and sticker portion 130 are separated from greeting card portion 120 to form a customized greeting card as shown in FIG. 4.

This second embodiment provides the advantage that stickers may be formed separately on different paper or with a different printing process while still retaining the advantages of providing a single unit greeting card kit. Larger and more diverse labels such as glossy labels, metallic labels, holographic labels, etc. may be provided in the single unit kit.

Figure 8:
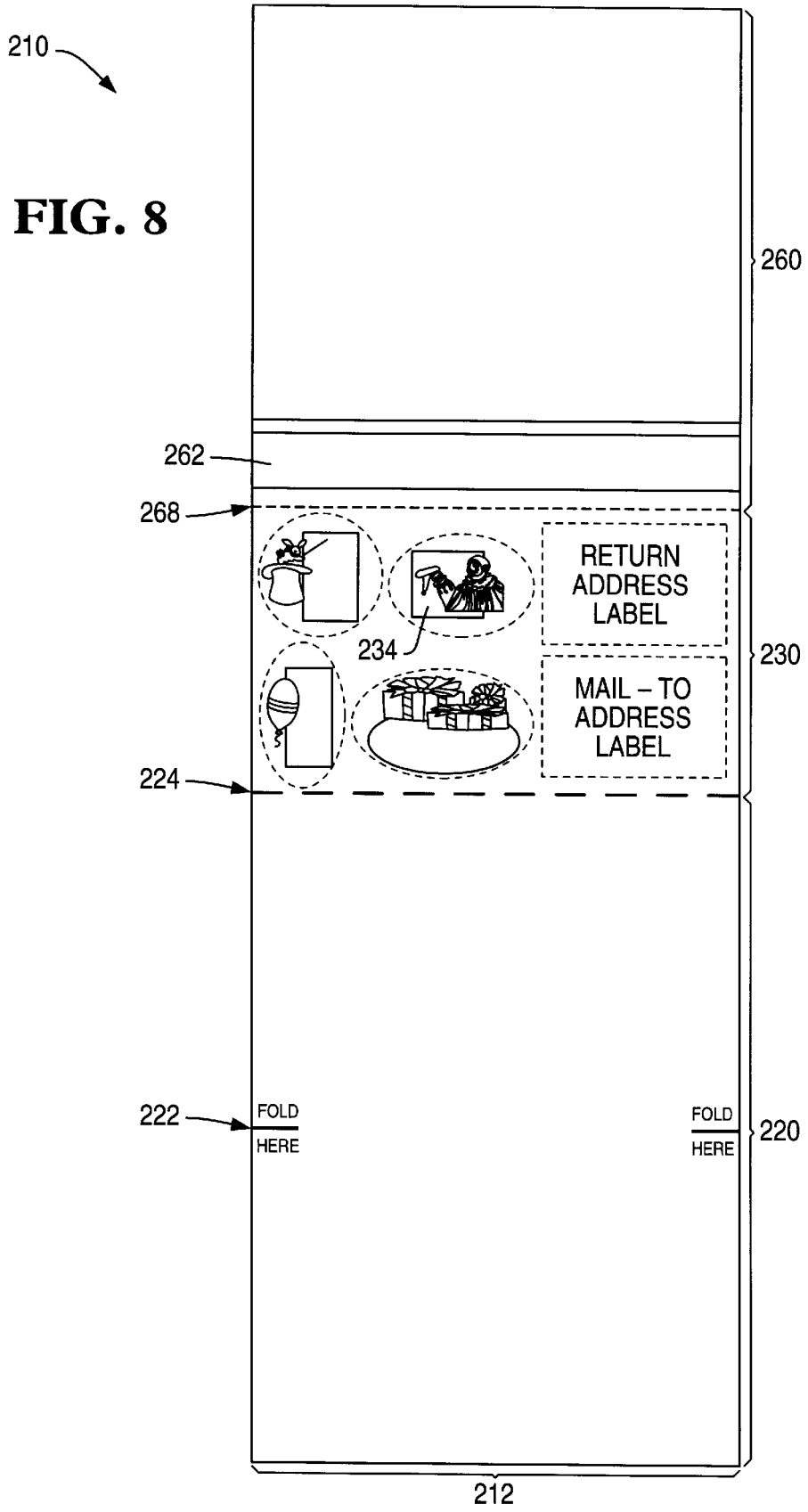
Figure 10:
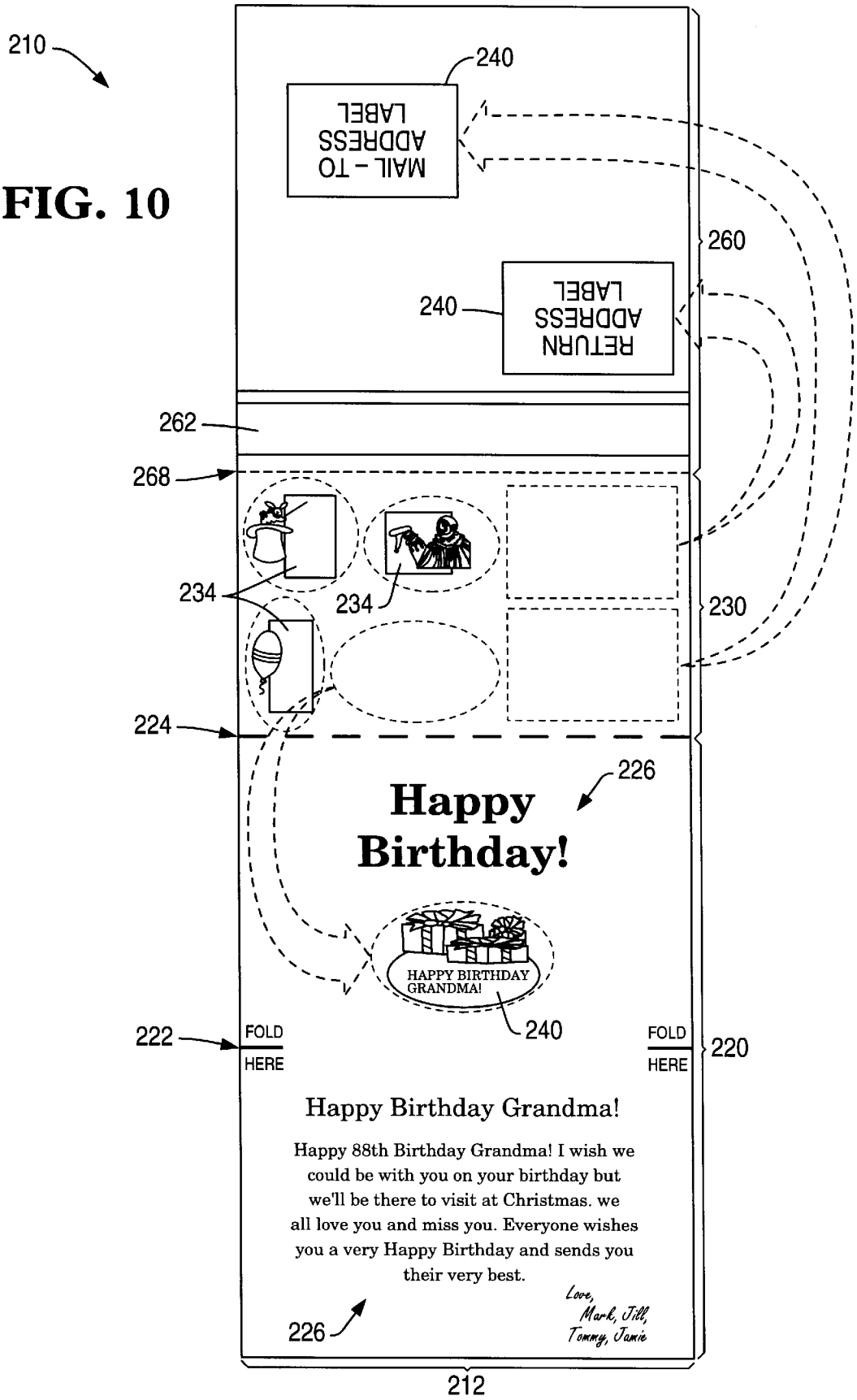

FIGS. 8, 9 and 10 show a greeting card kit according to a third embodiment of the present invention. FIG. 8 illustrates a top view of a greeting card kit 210 having a greeting card portion 220, an integrated sticker portion 230 and an integrated envelope portion 260. Greeting card portion 220 may be blank but may include a fold indication 222 or other standard printing. Alternatively, greeting card portion and/or sticker portion may be pre-printed. A first perforation line 224 divides greeting card portion 220 and sticker portion 230. A second perforation line 268 divides sticker portion 230 and envelope portion 260. Perforation lines 224 and 268 are preferably micro perforations. Greeting card kit 210 includes a greeting card portion 220 and integrated sticker portion 230 formed as described above with respect to the first embodiment and additionally includes an integrated envelope 260. Integrated envelope 260 is formed of paper sheet 212 and a second paper sheet as discussed below.

FIG. 9 illustrates a side view of the greeting card kit 210 of FIG. 8. Greeting card kit 210 includes a single sheet of paper 212 having a front surface 214 and a rear surface 216. Greeting card kit 210 includes an integrated envelope portion 260. Paper sheet 212 extends to form one side of integrated envelope portion 260. A pocket is formed by applying a permanent bond adhesive or glue 264 to three of the edges of envelope portion 260 on the rear surface 216 of paper sheet 212 and attaching a second sheet of paper 266. A layer of remoistenable glue 262 is also applied across the width of the card and to the rear surface 216 for the sealing of the envelope before mailing. In order to form a larger pocket for envelope portion 260, permanent bond or adhesive 264 may be applied to the front surface 214 of envelope portion 260 and second sheet of paper 266 may be folded on three edges to form a pocket with rear surface 216 of paper sheet 212 but being attached to front surface 214.

FIG. 10 shows the greeting card kit 210 of FIG. 8 which has been customized to provide a birthday card for "Grandma". Personalized greetings and information 226 may be added by hand, type writer or computer generation. If computer generation is selected, the user has preferably been provided with specialized software to instruct the computer and printer what and where to print on the card portion and/or the sticker portion. Selected stickers 234 are removed from sticker portion 230 and include paper and adhesive as the adhesive releases from the release liner 238. The greeting card is customized with selected sticker 240 applied to the front surface 214 or rear surface 216 of paper sheet 212 in the greeting card portion 220. Additionally if a mailing address or return address portion is desired, the integrated envelope is customized with stickers 240 applied to the front surface 214 of paper sheet 212 in the envelope portion 260. After customization, sticker portion 230 and envelope portion 260 are bursted (removed) from greeting card portion 220 to form a customized greeting card as shown in FIG. 4. These address labels can be hand printed or software generated from a computer and printer. This greeting card kit can also be produced to be compatible with different variations of pre-printed and either hand printed or computer generated information by the actual end-user.

This third embodiment provides advantages in handling in a single unit card, integrated stickers and its integrated mailing envelope construction.

Although the greeting card kits in the described embodiments have a birthday theme, it is contemplated that cards having a variety of themes may be produced. Additionally, although the described embodiments show a single use card, it is contemplated that multiple identical customized cards can be produced using the above kits, such as for thank you notes or invitations for weddings, funerals, celebrations, parties, showers, etc. Included in all the above embodiments is the ability to provide either pre-printing or custom printing or writing on either one or both sides of the greeting card portion of the greeting card kit.

Although the invention has been described with particular reference to certain preferred embodiments thereof, variations and modifications of the present invention can be effected within the spirit and scope of the following claims.

What is claimed is:

1. A greeting card kit, comprising:

a single sheet of paper having a pre-printed greeting card portion and an integrated sticker portion, the greeting card kit is constructed to be fed through a computer printer to enable printing of personalized information to create a customized greeting card and wherein at least a portion of said integrated sticker portion is pre-printed to correspond to said pre-printed greeting card portion providing a professionally finished customized greeting card.

2. The greeting card kit of claim 1 wherein said sheet of paper is bond paper.

3. The greeting card kit of claim 1 wherein said sheet of paper further includes an integrated envelope.

4. The greeting card kit of claim 1 wherein said sheet of paper has non-laminated surfaces adapted to receive writing or printing.

5. The greeting card kit of claim 1 wherein said greeting card portion is pre-printed for a specific theme and said sticker portion is pre-printed with indicia corresponding to said specific theme.

6. The greeting card kit of claim 5 wherein said greeting card portion has a surface for receiving at least one of hand printing and computer-generated printing and said sticker portion has a surface for receiving at least one of hand printing and computer-generated printing.

7. A greeting card kit, comprising:

a pre-printed greeting card portion;

a sticker portion; and a lap joined portion for attaching said card portion and said sticker portion, wherein the greeting card kit is constructed to be fed through a computer printer to enable printing of personalized information to create a customized greeting card and wherein at least a portion of said integrated sticker portion is pre-printed to correspond to said pre-printed greeting card portion providing a professionally finished customized greeting card.

8. The greeting card kit of claim 7 wherein said greeting card portion is pre-printed for a specific theme and said sticker portion is pre-printed with indicia corresponding to said specific theme.

9. The greeting card kit of claim 7 wherein said sticker portion is pre-printed using glossy, metallic or holographic printing.

10. A greeting card kit comprising:

a single sheet of paper including a greeting card portion and an integrated sticker portion wherein said integrated sticker portion includes a layer of pressure sensitive adhesive and a release liner with stickers being formed by die-cutting said sheet of paper in said sticker portion, wherein the greeting card kit is constructed to be fed through a computer printer to enable printing of personalized information to create a customized greeting card and wherein at least a portion of said integrated sticker portion is pre-printed to correspond to said pre-printed greeting card portion providing a professionally finished customized greeting card.

11. The greeting card kit of claim 10 wherein said greeting card portion is pre-printed for a specific theme and said sticker portion is pre-printed with indicia corresponding to said specific theme.

12. The greeting card kit of claim 11 wherein said sheet of paper has non-laminated surfaces adapted to receive writing or printing.

* * * * *